United States Patent [19]

Parsons

[11] Patent Number: 5,018,575

[45] Date of Patent: May 28, 1991

[54] APPARATUS FOR REDUCING ABRASION AND CORROSION IN MANDRELS

[75] Inventor: Ronald C. Parsons, Houston, Tex.

[73] Assignee: Mandrels, Inc., Houston, Tex.

[21] Appl. No.: 471,056

[22] Filed: Jan. 22, 1990

Related U.S. Application Data

[63] Continuation of Ser. No. 262,426, Oct. 25, 1988, abandoned.

[51] Int. Cl.[5] ..... E21B 17/10; E21B 17/18

[52] U.S. Cl. ..... 166/242; 285/55

[58] Field of Search ..... 166/117.5, 242, 372, 166/68; 137/155; 417/109-117; 285/16, 17, 422, 55

[56] References Cited

U.S. PATENT DOCUMENTS

| | | | |
|---|---|---|---|
| 1,153,684 | 9/1915 | Griffin . | |
| 1,246,189 | 11/1917 | Vanderlip . | |
| 1,272,794 | 7/1918 | Girtanner . | |
| 1,324,980 | 12/1919 | Poppenhusen et al. . | |
| 1,744,361 | 1/1930 | Carlisle | 417/116 |
| 1,985,973 | 1/1935 | Boynton | 417/110 |
| 2,207,118 | 7/1940 | Crickmer et al. | 417/115 |
| 2,232,135 | 2/1941 | Pate | 285/146 |
| 2,482,962 | 9/1949 | Boice | 285/146 |
| 2,725,014 | 11/1955 | Pryor | 137/155 |
| 2,845,940 | 8/1958 | Garrett et al. | 137/155 |
| 2,955,847 | 10/1960 | McKenna | 280/411 |
| 3,492,025 | 1/1970 | Holland | 285/16 |
| 3,829,245 | 8/1974 | Evans | 417/108 |
| 4,567,954 | 2/1986 | Voight, III et al. | 175/424 |
| 4,600,219 | 7/1986 | Yoshida et al. | 285/55 |

OTHER PUBLICATIONS

CAMCO Condensed Catalog, pp. 13-14, 1986.

*Primary Examiner*—Hoang C. Dang

*Attorney, Agent, or Firm*—Pravel, Gambrell, Hewitt, Kimball & Krieger

[57] ABSTRACT

An insert for use in a mandrel used in the production string of a well utilizing a gas lift operation is disclosed. The tubing unit and the valve lug forming the mandrel have communicating bores into which the insert, which is formed of an abrasion resistant material such as carbide, is placed. The insert is soldered in place, with the soldering to the valve lug being accomplished through a temporary opening in the valve lug. A method for assembly of the mandrel is described and an abrasion resistant sleeve for inclusion in a valve lug for use with a fluid operated valve is disclosed.

2 Claims, 3 Drawing Sheets

APPARATUS FOR REDUCING ABRASION AND CORROSION IN MANDRELS

This is a continuation of co-pending application Ser. No. 262,426, filed on Oct. 25, 1988, now abandoned.

BACKGROUND OF THE INVENTION

1. Field of the Invention

The present invention relates to the field of oil field production equipment, and more particularly to items used in gas lift production operations.

2. Description of Prior Art

In hydrocarbon production, commonly the pressure in the reservoir being produced is not great enough to force the oil to the surface. The two most common methods used for bringing the oil to the surface are pumping and artificial or gas lift.

Gas lift utilizes the standard well configuration where there is an outer casing or annulus and an interior production tubing string. A seal is located above the casing perforation zone, where the hydrocarbons enter the casing, so that there is a closed volume between the casing and the production string above the seal. Below the seal the production string is open to allow the hydrocarbons to enter the production string. A gas lift operation involves forcing compressed natural gas down into the well bore into the fixed volume zone above the seal and around the outside of the production tubing and inside the casing.

Specialized devices called mandrels are positioned at various levels in the production string to allow the compressed gas to enter the casing. A mandrel generally has two parts. The first part is referred to as the tubing unit which is a modified piece of pipe similar to the pipe used in the production string The tubing unit has a port or series of ports to allow the compressed gas to enter the production string. The second part of a conventional mandrel is a valve lug which is attached to the tubing unit. The lug has a port or series of ports which are aligned with the port or series of ports in the tubing unit. The lug is further designed to hold a valve used in gas lift operations to control entry of the compressed gas into the production string and thereby cause a quantity of hydrocarbon fluid to move up the production tubing to the surface. The gas aerates the hydrocarbon fluid, which makes the fluid exert less pressure than the formation, so that the formation pressure forces the fluid to the surface. A common problem associated with gas lift operation is the corrosion and abrasion, which are generally referred to herein as erosion, to the ports in the mandrel by the compressed gas as it passes through the valve and enters the production string, and by the fluids and any incorporated impurities, such as hydrogen sulfide and sand, flowing in the production tubing.

There are two valve types which are commonly used, and they are referred to as fluid operated and pressure operated. Pressure operated valves are generally designed so that the flow path in the valve lug is parallel with the production tubing after the gas exits the valve. As a result, the major erosion location of a mandrel with a pressure operated valve is the port into the tubing unit. On the other hand, fluid operated valves generally have radial gas ports so that the gas exits perpendicular to the valve lug axis. The gas flow must then bend to allow the gas to traverse the port into the tubing unit. Erosion of the valve lug thus occurs opposite each valve port, as well as the erosion which occurs at the port into the tubing unit.

When a single mandrel erodes to the point of leaking, the entire production string must be pulled from the well and at least the damaged parts are replaced. Generally, when one mandrel is replaced, all the mandrels in the string are replaced to prevent pulling the production string for each mandrel failure. Pulling the production string and the replacement of all the mandrels is a large expense and so it is desirable to reduce the erosion rate of the mandrel and the frequency of pulling the production string and replacing the mandrels.

U.S. Pat. No. 4,567,954 discloses a tungsten carbide drill bit having a replaceable tungsten carbide nozzle for aiming the drilling fluids used when the bit is operating. The nozzle has an external threaded sleeve which is brazed on the nozzle and used &o allow the nozzle assembly to thread into the bit. Alternately, the nozzle is held in place by a snap ring.

SUMMARY OF THE INVENTION

The device of the present invention includes a mandrel for use in an artificial lift operation of a producing oil well. The mandrel contains an insert, preferably formed of a tungsten carbide material, incorporating the ports formerly in the valve lug and the tubing unit to reduce the erosion created by the flow of gas from the casing to the interior of the production string and the flow of fluids and associated impurities up the production string. The port in the insert has the same effective flow rate as the port or series of ports in conventional mandrels. The tubing unit and the valve lug have holes into which the insert is positioned. The insert preferably is shouldered so that the diameter of the insert portion in the valve lug is greater than the diameter of the portion in the production tubing. The shouldering prevents the insert from falling into the production tubing during assembly and production operations.

If the mandrel is being used with a fluid operated valve, a sleeve, also preferably formed of tungsten carbide, is positioned in the valve lug opposite the radial ports in valve. The sleeve reduces the erosion rate at this point. Alternatively, the sleeve can be combined with the insert to form a single unit.

The present invention also includes a method of installing the insert into the mandrel. The method includes silver soldering the insert into a hole in the tubing unit. The valve lug is then welded to the tubing unit by conventional methods. Following this, the insert is silver soldered to the valve lug through an opening in the valve lug opposite the insert. The opening in the valve lug opposite the insert is then filled by conventional methods and any finishing steps are performed.

DETAILED DESCRIPTION OF THE EXEMPLARY EMBODIMENTS

Figures 1, 2, 3, 4:
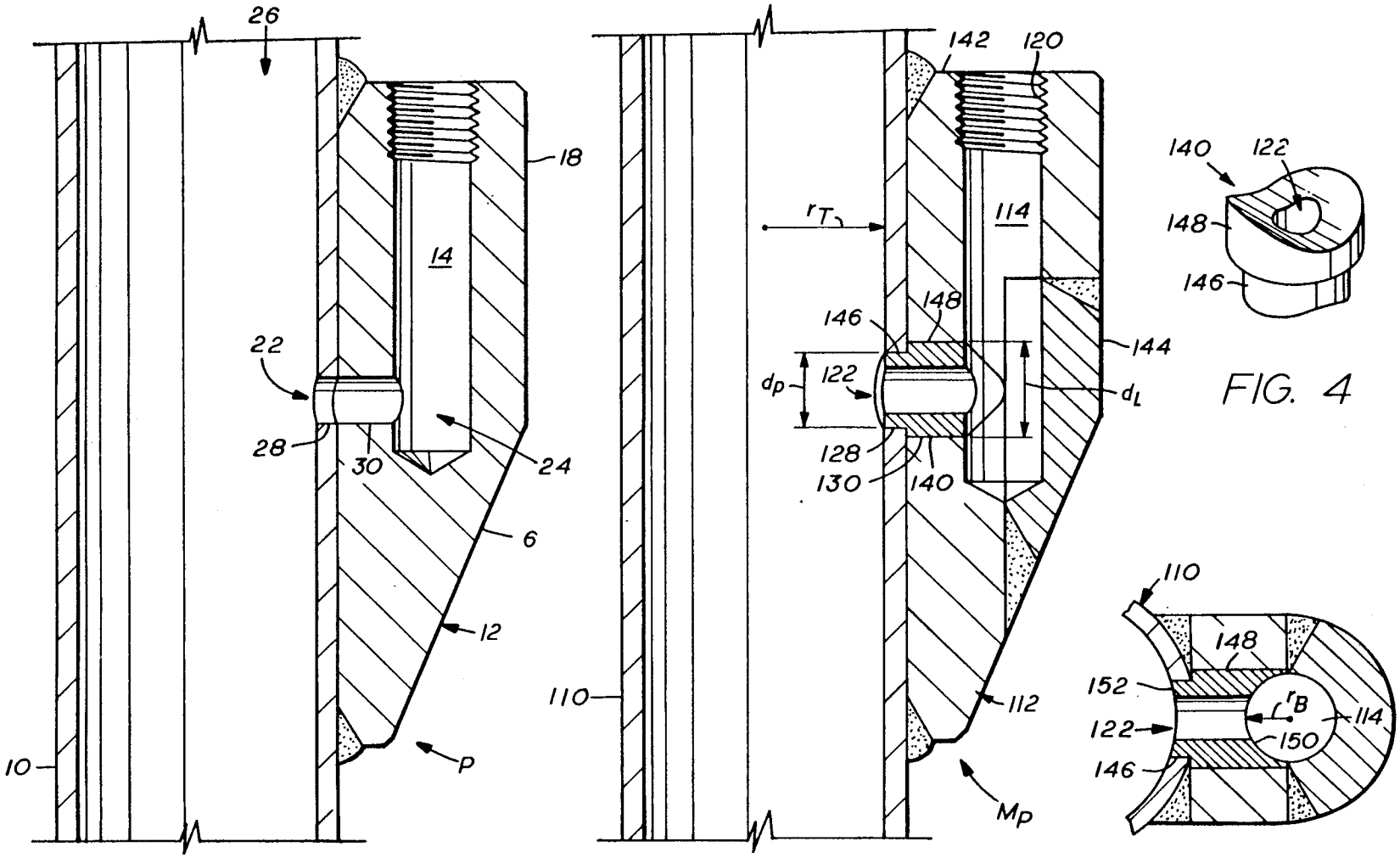
FIG. 1 (PRIOR ART)
FIG. 1 is a longitudinal, cross-sectional view of portions of for a pressure operated valve according to the prior art.
FIG. 2 is a longitudinal, cross-sectional view of portions of a for a pressure operated valve according to present invention.
FIG. 3 is a portion of a transverse, cross-sectional view of the mandrel of FIG. 2.
FIG. 4 is a perspective view of an insert according to the present invention.

A conventional mandrel according to the prior art, generally referred to by the letter P, as shown in FIG. 1, was designed for use with a pressure operated valve (not shown). The conventional mandrel P has a tubing unit 10 formed of production tubing for inclusion in the production string in the well. The tubing unit 10 includes appropriate fittings (not shown) for mating with other portions of the production string. Attached to the tubing unit 10 is a valve lug 12, in this case a valve lug to use with a pressure operated valve. The valve lug 12 has a tapered end 16 at the downhole side to allow the mandrel to be easily placed in the well. The valve lug 12 has an axial bore 14 having an opening on the generally non-tapered end 18 of the valve lug 12. A portion 20 of the bore 14 near the opening is threaded to allow attachment of the pressure operated valve.

A port 22 exists from the closed end 24 of the bore 14 to the inside 26 of the tubing unit 10. The port 22 is formed by a hole 28 in the tubing unit: 10 and an aligned hole 30 in the valve lug 12. While only a single communicating hole is being used in this description to form the port 22, it is understood that a series of holes can be used to form the port, with the size of the holes varying based on the number of holes and the desired flow rates.

When the valve opens because it senses a preset pressure outside the mandrel P, the gas used in the gas lift operation flows from the valve lug 12 to the tubing unit 10 through the port 22. The port 22 enlarges due to the erosion caused by the gas and the gas flow and due to the erosion caused by the turbulent flow of the fluids and accompanying contaminants, such as hydrogen sulfide and sand, in the production tubing, until eventually the port 22 is sufficiently enlarged so that a leak is formed outside the mandrel P, allowing the pressurized gas outside the mandrel P to enter the production tubing 10 without passing through the valve, thus hindering gas lift operations.

A mandrel Mp (FIG. 2) according to the present invention includes a portion of production tubing forming a tubing unit 110 and a valve lug 112. In the mandrel Mp a port 122 from the valve lug 112 to the tubing unit 110 is contained in an insert 140 (FIG. 4). The insert 140 is preferably formed of tungsten carbide because tungsten carbide better resists the erosion caused by the gas, the gas flow, and the fluid flow than the steel of the tubing unit 110 and the valve lug 112. Tungsten carbide exhibits superior abrasion wear characteristics when compared with the base metal of the mandrel Mp, thereby decreasing erosion of the port 122 due to the gas flow, the fluid flow and the contaminants therein. Additionally, a tungsten carbide insert 140 better resists the corrosive environment within the well bore. It is understood that the insert 140 can be formed of other suitable long wearing materials such as aluminum oxide.

The insert 140 is preferably silver soldered into an enlarged hole 128 in the tubing unit 110 and into an enlarged hole 130 in the valve lug 112. The use of silver solder or other suitable high temperature fixation technique allows the insert 140 to stay in proper position during the assembly and production operations when high temperatures are developed due to welding and downhole location.

The insert 140 is preferably shouldered, having a tubing portion 146 with a diameter $d_P$ where the insert 140 mates with the tubing unit 110 and a lug portion 148 with a larger diameter $d_L$ where the insert mates with the valve lug 112. This shouldering prevents the insert 140 from falling into the tubing unit 110 during assembly or production operations.

The upper surface 150 (FIG. 3) of the lug portion 148 is formed to be concave and has a radius $r_B$ approximately equal to the bore 114 of the valve lug 112. The lower surface 152 of the tubing portion 146 is also concave and has a radius $r_T$(FIG. 2) approximately equal to the inner radius of the tubing unit 110. These radiused surfaces 150 and 152 allow conventional valves and tools to be inserted and used in the valve lug 112 and the production string without interfering with their operation and allow the mandrel Mp to maintain approximately the same resistance to hydrocarbon and gas flow as the conventional mandrel P. The height of the insert 140 is such that the upper and lower surfaces 150 and 152 align with their appropriate bores when the valve lug 112 is attached to the tubing unit 110.

While in the conventional mandrel P the valve lug 12 is formed of a single piece, the valve lug 112 of the mandrel Mp is formed of at least two pieces 142 and 144. The first piece 142 is the main body of the valve lug 112 and is mated with the insert 140 and is welded to the tubing unit 110. Additionally, a threaded portion 120 of an axial bore 114 of the valve lug 112 for mating with the valve is located in the body piece 142. The second piece 144 is a back piece and is located opposite the insert 140. The back piece 144 is not welded to the body piece 142 until after the body piece 142 is silver soldered to the insert 140. The opening that exists when the back piece 144 is not in place allows easy access to the insert 140 during the silver soldering operation. The back piece 144 is welded to the body piece 142 and the weld is preferably removed so that a smooth surface exists on the valve lug 112, thereby not creating additional problems when the mandrel Mp is placed in the production string and inserted or removed from the well.

Figure 7A:
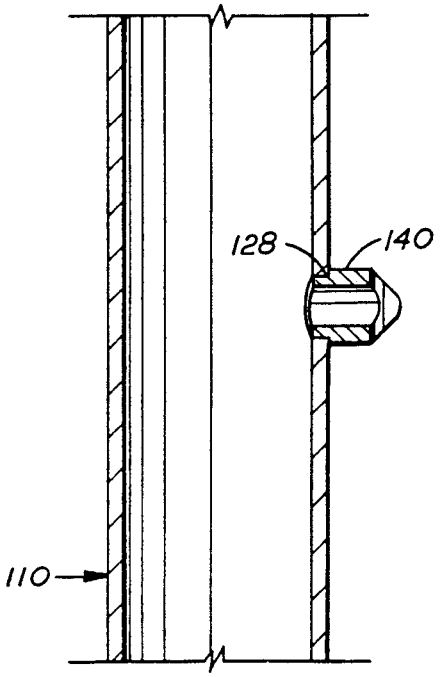
FIGS. 7A–7C are longitudinal, cross-sectional views of portions of a mandrel for a pressure operated valve according to invention in various stages of assembly.

The mandrel Mp is preferably assembled according to the following sequence. The hoe 128 (FIG. 7A) into which the insert 140 will be fitted is made in the tubing unit 110. The insert 140 is then placed into the hoe 128, preferably with a silver solder flux on the mating surfaces. The lower surface 152 of the insert 140 is aligned with the inner surface of the tubing unit 110. The insert 140 is then silver soldered to the tubing unit 110.

Figure 7B:
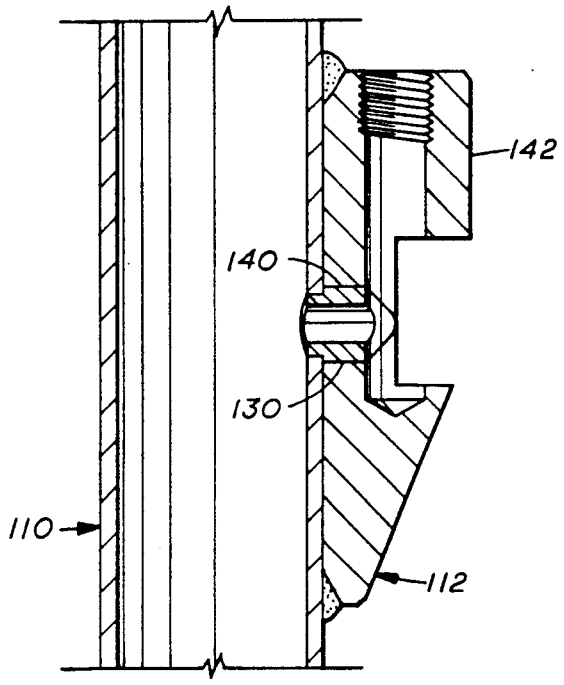
Figure 7C:
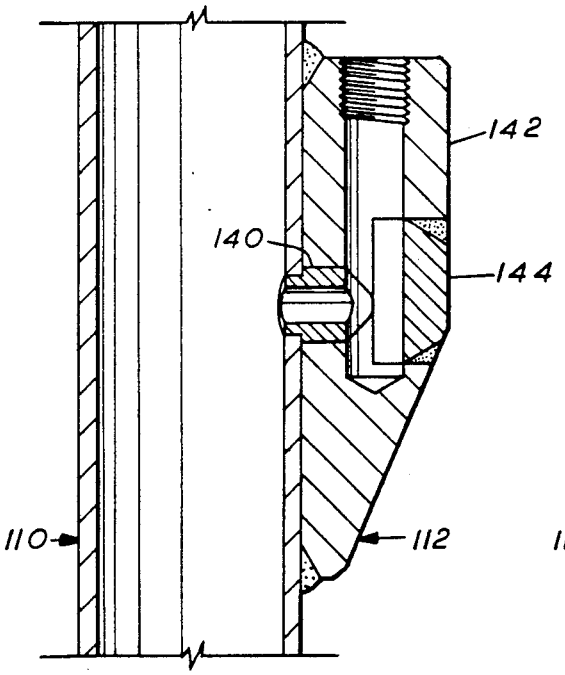
Figure 7D:
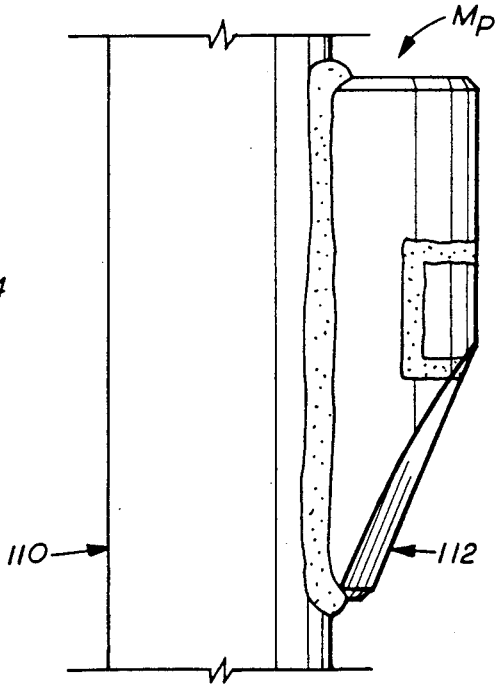
FIG. 7D is a longitudinal view of portions of a completed mandrel for a pressure operated valve according to the present invention.

The body portion 142 of the valve lug 112 has been previously prepared, with the insert hole 130 and the bore 114 with its threaded end 120 being completed. A silver solder flux is applied, if desired, to the mating surfaces of the insert 140 and the body portion 142. The body portion 142 is then mated with the insert 140 (FIG. 7B) and positioned so that the body portion 142 is colinear with the tubing unit 110 and thereby the upper surface 150 of the insert 140 and the surface of the bore 114 align. The body portion 142 is welded to the tubing unit 110 to firmly attach the valve lug 112 to the tubing unit 110. Next, the insert 140 is silver soldered to the body portion 142 using the access provided because the back portion 144 has not been attached. The back portion 144 of the valve lug 112 is positioned on the body portion 142 (FIG. 7C) and welded to form a permanent attachment. The various welds can then be ground down if desired to provide a smooth surface to the valve lug 112 (FIG. 7D) and other finishing operations performed.

Figure 5:
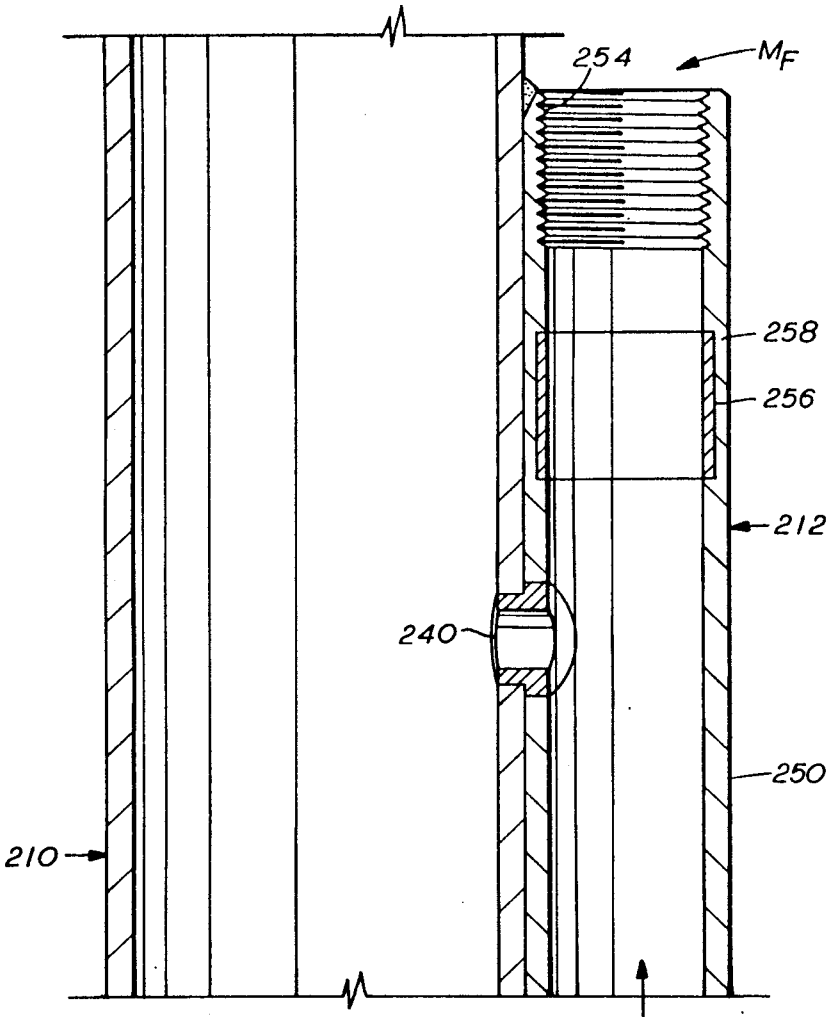
FIG. 5 is a longitudinal, cross-sectional view of portions of a mandrel for a fluid operated valve according to the present invention.

A mandrel $M_F$ (FIG. 5) for use with a fluid operated valve can be constructed according to the present invention. The mandrel $M_F$ has a production tubing unit 210, a valve lug 212, and an insert 240. The tubing unit 210 and the insert 240 are similar to the tubing unit 110 and the insert 140 of the mandrel Mp. The valve lug 212 differs because standard pressure operated valves are located primarily outside the valve lug and fluid operated valves (not shown) are located primarily inside the valve lug 212. As a result the valve lug 212 is a tube 250 having a bore 252 which is the length of the tube 250 and has openings at both ends. The end 254 of the tube 250 near the insert 240 is threaded to receive the fluid operated valve.

The valve lug 212 additionally includes a sleeve 256, preferably formed of carbide. As previously discussed, a fluid operated valve has radial valve ports, with the resulting gas and gas flow eroding the opposed portions of the valve lug 212 as well as the port. The sleeve 256 is located in the valve lug 212 so that the sleeve 256 is opposite the radial valve ports. Thus, the erosion rate of the valve lug 212 at this location is reduced. The sleeve 256 has an inner diameter approximately equal to the inner diameter of the valve lug 212. The valve lug 212 contains a groove 258 having a depth approximately equal to the thickness of the sleeve 256 so that the sleeve 256 can be positively located in the valve lug 212.

Figure 6:
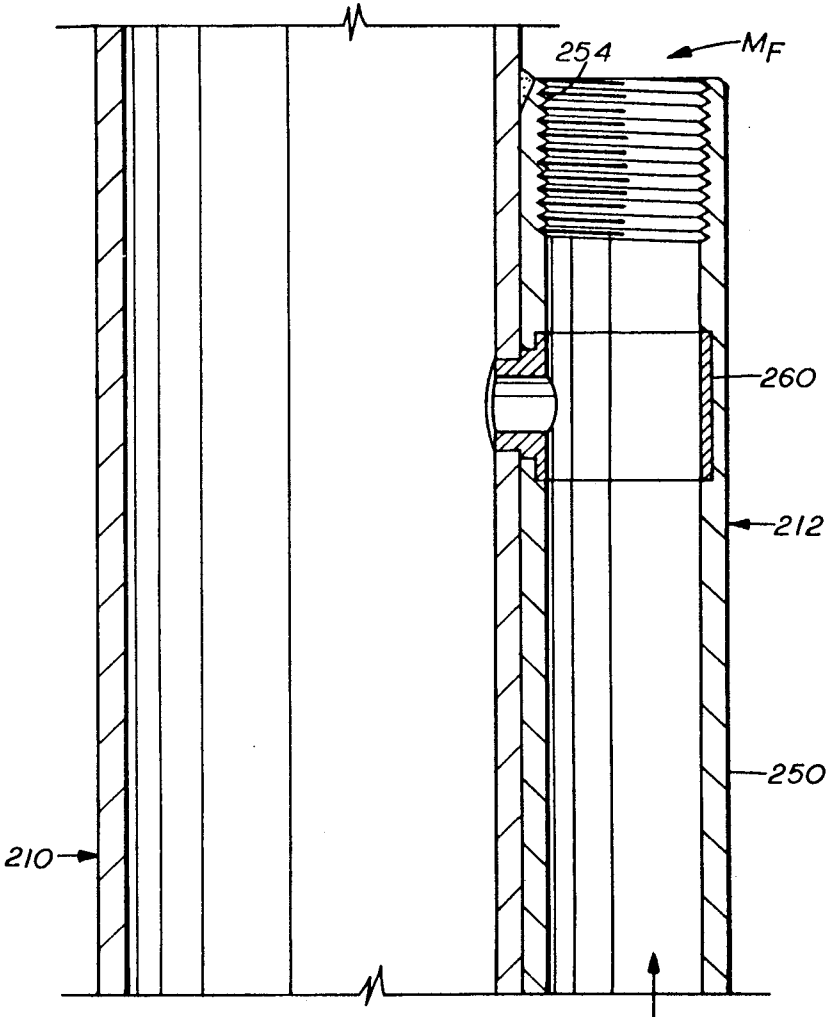
FIG. 6 is a longitudinal, cross-sectional view of an alternate embodiment of the mandrel of FIG. 5.

In an alternate embodiment (FIG. 6), the insert and the sleeve are combined to form a combined unit 260 which can be used when the radial valve ports on the fluid operated valve align with the desired location of the port from the valve lug 212 to the tubing unit 210.

The foregoing disclosure and description of the invention are illustrative and explanatory thereof, and various changes in the size, shape and materials, as well as in the order and details of the illustrated construction may be made without departing from the spirit of the invention.

I claim:

1. An apparatus for insertion into a production string for facilitating a gas lift operation in a producing well, the well having a tubular casing, a tubular production string inside the casing, a means for providing gas to the space between the casing and producing string and at least one valve which opens at a desired pressure differential to aid in controlling flow of the gas between the space and the producing string, the valve having radial gas ports, the apparatus comprising:

a tubing unit for connection with the production string, said tubing unit being tubular in form and having interior and exterior cylindrical surfaces defining a wall, the interior and exterior radial dimensions of said wall being similar to the equivalent radial dimensions of the production string to which said tubing unit is connected, so as to form a smooth connection between said tubing unit and the production string, said wall having a transverse through bore;

a valve lug, mounted to said exterior surface of said tubing unit, being generally tubular in form, having interior and exterior cylindrical surfaces defining a wall, having a first end adapted to receive the valve, and having a transverse through bore formed in said wall adjacent to said bore in said tubing unit to provide fluid communication between the interior of said tubing unit and the interior of said valve lug;

a tubular insert formed of material having an abrasion resistance appreciably greater than the material of said tubing unit and said valve lug, said insert having interior and exterior surfaces defining a wall positioned in said communicating bores of said tubing unit and said valve lug and attached to said tubing unit and said valve lug; and a generally cylindrical tubular sleeve formed of material having an abrasion resistance appreciably greater than the material of said tubing unit and said valve lug, said sleeve having interior and exterior surfaces defining a wall, the diameter of said inner surface being approximately equal to the diameter of said inner surface of said valve lug; and wherein said inner surface of said valve lug includes a groove, said groove depth being approximately the thickness of said sleeve wall, said groove being located adjacent the location of the radial ports of the valve when the valve is installed in the apparatus, said tubular sleeve being located in said groove.

2. The apparatus of claim 1, wherein said tubular insert and said tubular sleeve form a unit.

* * * * *